US005186343A

United States Patent [19]

Bozzi

[11] Patent Number: 5,186,343

[45] Date of Patent: Feb. 16, 1993

[54] BRIDGE CRANE WITH ARTICULATED ROTARY BOOM

[75] Inventor: Eugenio Bozzi, Monza, Italy

[73] Assignee: ITI/CLM Impianti Tecnici Industriali SpA, Buttrio, Italy

[21] Appl. No.: 493,746

[22] Filed: Mar. 15, 1990

[30] Foreign Application Priority Data

Mar. 21, 1989 [IT] Italy ..... 83358 A/89
Jan. 5, 1990 [IT] Italy ..... 83301 A/90

[51] Int. Cl.[5] ..... B66C 17/04

[52] U.S. Cl. ..... 212/206; 212/195; 212/211; 414/917

[58] Field of Search ..... 212/142.1, 205-206, 212/211-213, 224, 227, 165, 188, 171, 220, 255, 231-232, 237-238, 214, 261, 195, 196, 197, 198; 901/15-16; 414/721, 496, 917

[56] References Cited

U.S. PATENT DOCUMENTS

| | | | |
|---|---|---|---|
| 551,831 | 12/1895 | Morgan | 212/213 |
| 854,837 | 5/1907 | Paige | 212/206 |
| 1,035,265 | 8/1912 | Taylor | 212/211 |
| 1,429,012 | 9/1922 | Andrews | 212/224 |
| 1,768,542 | 7/1930 | Clausing | 212/224 |
| 2,679,938 | 6/1954 | Willows | 212/224 |
| 2,846,081 | 8/1958 | Moore | 212/211 |
| 2,964,459 | 12/1960 | Pearson | 212/213 |
| 3,179,264 | 4/1965 | Tallquist . | |
| 3,540,603 | 11/1970 | Neumeier | 212/211 |
| 3,884,359 | 5/1975 | Suverkrop | 212/238 |
| 4,181,231 | 1/1980 | Morrissey, Jr. . | |
| 4,360,112 | 11/1982 | Brewer et al. | 212/206 |
| 4,646,875 | 3/1987 | Sholl | 212/238 |
| 4,668,155 | 5/1987 | Kaufmann et al. | 901/15 |
| 5,037,267 | 8/1991 | Warner et al. | 414/917 |

FOREIGN PATENT DOCUMENTS

| | | | |
|---|---|---|---|
| 0018466 | 11/1980 | European Pat. Off. . | |
| 16142 | 11/1956 | Fed. Rep. of Germany | 212/211 |
| 1021550 | 12/1957 | Fed. Rep. of Germany | 212/206 |
| 2137722 | 4/1973 | Fed. Rep. of Germany . | |
| 2421217 | 11/1975 | Fed. Rep. of Germany . | |
| 2558724 | 7/1977 | Fed. Rep. of Germany . | |
| 3151402 | 7/1983 | Fed. Rep. of Germany . | |
| 8708888 | 9/1987 | Fed. Rep. of Germany . | |
| 611019 | 5/1978 | U.S.S.R. | 212/211 |
| 697316 | 11/1979 | U.S.S.R. | 414/917 |
| 867851 | 9/1981 | U.S.S.R. | 212/142.1 |
| 1305027 | 4/1987 | U.S.S.R. | 414/917 |
| 1232873 | 5/1971 | United Kingdom . | |

*Primary Examiner*—Sherman Basinger
*Assistant Examiner*—Thomas J. Brahan
*Attorney, Agent, or Firm*—Antonelli, Terry, Stout & Kraus

[57] ABSTRACT

Bridge crane with articulated rotary boom, which includes a beam (13) that supports a boom (17) able to rotate in a substantially horizontal plane about a substantially vertical pivot (14), which is located substantially at the center of the span of the beam (13) and is fixed below the beam (13), the boom (17) consisting of at least two elements (18-118-218) which can be positioned vertically in relation to each other by means of cylinder/piston actuators (121-221), the boom (17) being anchored by means of its first element (18) to a rotary platform (24) positioned below the beam (13), an operator's cage (15) and a motor unit (16) located below the beam (13) being comprised in cooperation with the central pivot (14) of rotation, the motor unit (16) being offset laterally in contraposition to the boom (17) so as to act as a counterweight, the first element (18) of the boom (17) being able to oscillate and to be positioned vertically by means of a first cylinder/piston actuator (21).

8 Claims, 2 Drawing Sheets

BRIDGE CRANE WITH ARTICULATED ROTARY BOOM

This invention concerns a bridge crane with an articulated rotary boom. To be more exact, the invention concerns a bridge crane with a centrally positioned boom able to rotate on a substantially horizontal plane and to move on a vertical plane. The boom is articulated and able to oscillate on its pivot of rotation.

Zignoli-Trasporti Meccanici, Volume II, 1952 Edition, Hoepli, page 897 discloses bridge cranes having a rotatable boom secured to the trolley. These bridge cranes are supplied normally for installation in a central shed and can work also at the same time in lateral sheds to engage and handle raw materials or products. These known cranes employ cables, winches and normal usage and handling means, but cannot be used, for instance, in environments where there are dangerous vapours or gases owing to the possible occurrence of sparks. Moreover, the employment of cables and winches leads to a slow handling and movement system.

Furthermore, the use of a movable trolley makes the operator coordinate two successive approximations and therefore employ long times for alignment and engagement.

When it is necessary to work by engaging materials within a central area of the shed or within the area served by the crane, the time factor being very important in such engagement, the known cranes are unsatisfactory owing to the working times they require.

Moreover, the employment of slide blocks and, more generally, the use of movable parts on the runways are severe handicaps in dusty environments since the wear caused is very heavy.

DE-U-8.708.888 discloses a crane, advantageously a crane to handle fodder, positioned on a trolley able to move on runways. This teaching is useful in limited environments free of dust with a relative light load on the boom.

DE-A-3.151.402 discloses a crane with a stationary vertical axis on a trolley able to move on runways. Thus far, this teaching is advantageous in dusty environments, but the employment of telescopic elements makes it unsuitable. Moreover, it cannot be used in tall sheds of an industrial type, and also the vertical area covered by the crane is relatively small.

DE-B-2.137.722 discloses a crane which can run along the length of an agricultural shed; the essential feature of the crane is the inclusion of a cam to regulate the reciprocal positions of the boom and the roof of the shed.

U.S. Pat. No. 4,181,231 discloses a crane able to move on a circular passageway along a runway borne on three arms.

However, these known teachings entail a plurality of shortcomings since they have a heavy structure in proportion to the load which they can handle; they do not permit swift handling of the load nor a great number of handlings per unit of time.

Moreover the known teachings provide for arms which if they are raised, interfere with the runways.

A further shortcoming is that these known teachings do not enable the cranes to move along the sides of the sheds at a very low height unless the cranes have slow and heavy structures.

Another shortcoming is the fact that the load-bearing boom does not stay parallel to itself when moving vertically.

To obviate the above shortcomings and to obtain the resulting advantages and further benefits to be found in the description that follows, the present applicant has designed, tested and embodied this invention.

The bridge crane with articulated rotary boom is set forth and characterized in the main claim, while the dependent claims describe variants of the idea of the embodiment.

According to the invention a bridge crane which can run on parallel runways is provided with a rotary boom positioned at the centre of the span of the bridge. This rotary boom comprises a fixed rotation pivot at a central position, the pivot being positioned substantially vertically and extending below the beam which forms the bridge.

An articulated rotary boom is anchored so as to be able to rotate on the pivot in a vertical plane and consists of at least two elements which can be positioned in relation to each other on a vertical plane by means of hydraulic cylinder/piston actuators.

According to a variant the second element of the boom is connected to the first element and to the pivot by means of an articulated quadrilateral system.

An operator's cage and, a unit to deliver fluid under pressure, the latter having counterweight functions, are included in substantial cooperation with the vertical pivot.

The beam of the bridge of a box-type and may be put under pressure and may allow passage within it.

According to a further variant the central portion of the boom that cooperates with the operator's cage can be made capable of moving in a vertical plane.

The spirit of the invention provides also for the last of the elements forming the boom to consist of two telescopic bodies, so as to increase the extent of lateral action in the ground area.

As we said above, according to a variant of the invention the boom has the conformation of a double articulated quadrilateral so as to be able to keep the terminal segment of the boom in the desired position and in positions parallel to one another, irrespective of the vertical position which the boom itself may take up.

Moreover, according to the invention the boom, in view of its conformation as a double articulated quadrilateral, never interferes with the runways or the upright pillars of the sheds during its movements.

The attached figures, in which like reference numerals represent like elements and which are given as a non-restrictive example, show the following:

Figure 1:
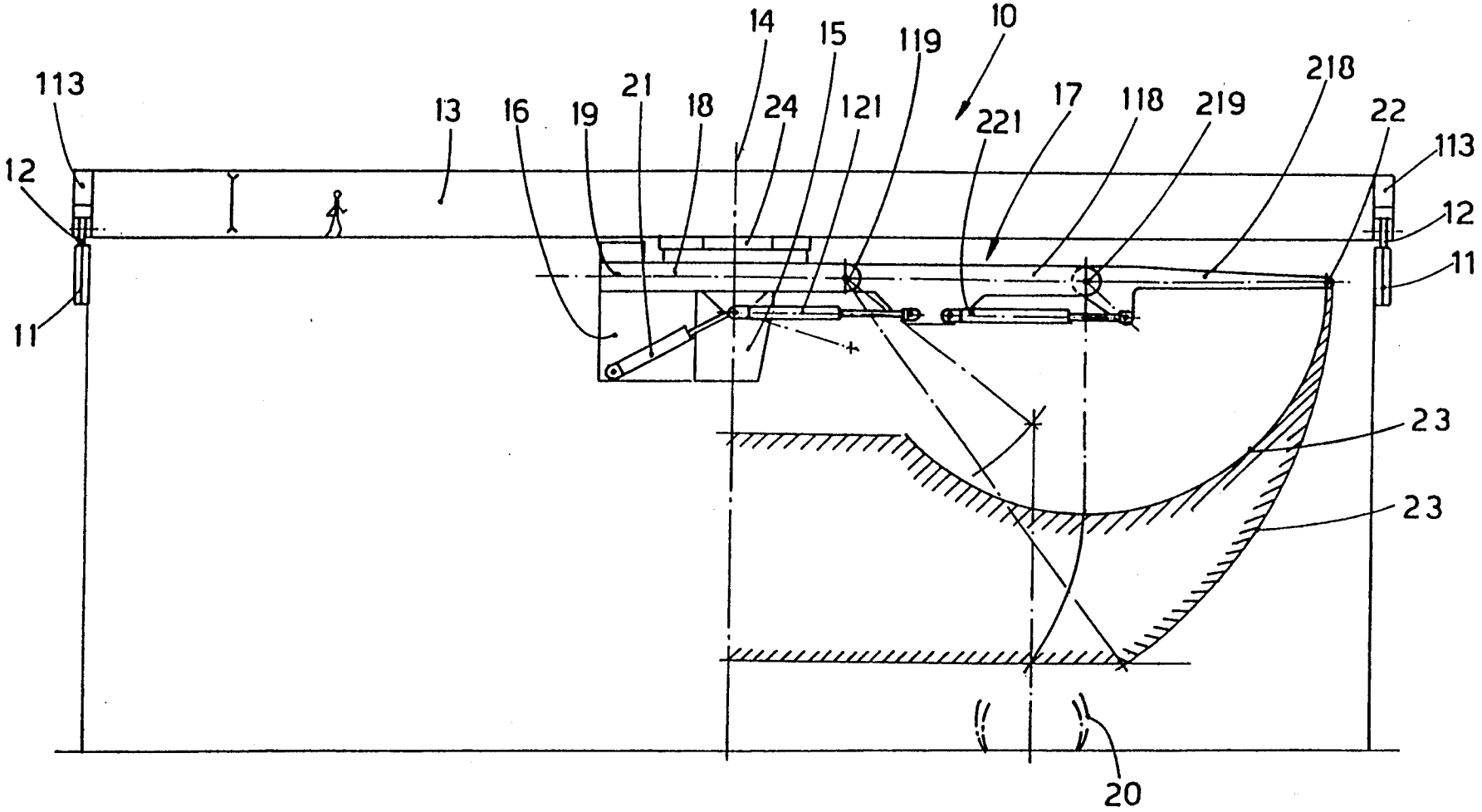
FIG. 1 is a side view of a possible embodiment of the invention.

In the figures a crane 10 runs on runways 11 which may be situated in a shed or be wholly or partly in the open. In this example the crane 10 comprises a beam with a central body 13 and wings 113. Wheels 12 are fitted advantageously on the wing 113. A vertically positioned central pivot 14 is comprised in the centre of the crane 10.

A platform 24 to which a rotary boom 17 is anchored is included on the axis of the central pivot 14.

In this case the rotary boom 17 comprises an operator's cage 15 substantially coaxial with the central pivot 14 and a motor unit 16 that acts also as a counterweight. The motor unit 16 includes the usual means to receive the required fluid under pressure for the actuation systems.

The cage 15 is shown in FIG. 1 as being central to the pivot 14 but in actual practice can also be positioned further forward or backward (FIG. 2) so as to improve vision in the central zone between the runways 11.

In FIG. 1 the boom 17 includes three movable elements 18-118-218; the first element 18 is hinged at 19 on the motor unit 16, the second element 118 is hinged at 119 on the first element 18 and the third element 218 is hinged at 219 on the second element 118.

According to a variant the first element 18 may be stationary and unable to oscillate.

In the example of FIG. 1 the vertical positioning is carried out as follows:

the first element 18 by means of a first cylinder/piston actuator 21 anchored to the motor unit 16;

the second element 118 by means of a second cylinder/piston actuator 121 anchored to the first element 18;

the third element 218, acting as a terminal boom, by means of a third cylinder/piston actuator 221 anchored to the second element 118.

According to the invention the third element 218, acting as a terminal boom, may be extended, for instance, by means of the employment of telescopic bodies or bodies positioned side by side. In this case a suitable fourth cylinder/piston actuator will be included to coordinate such extension.

In the embodiment of FIG. 1, if the first element 18 is stationary, the area served by an anchorage point 22 to which a grab or forks or a hoist 20 are secured is shown with dashes within peripheral lines 23.

If the third element 218 can be extended, then the lateral corners too of the shed can be served.

Figure 2:
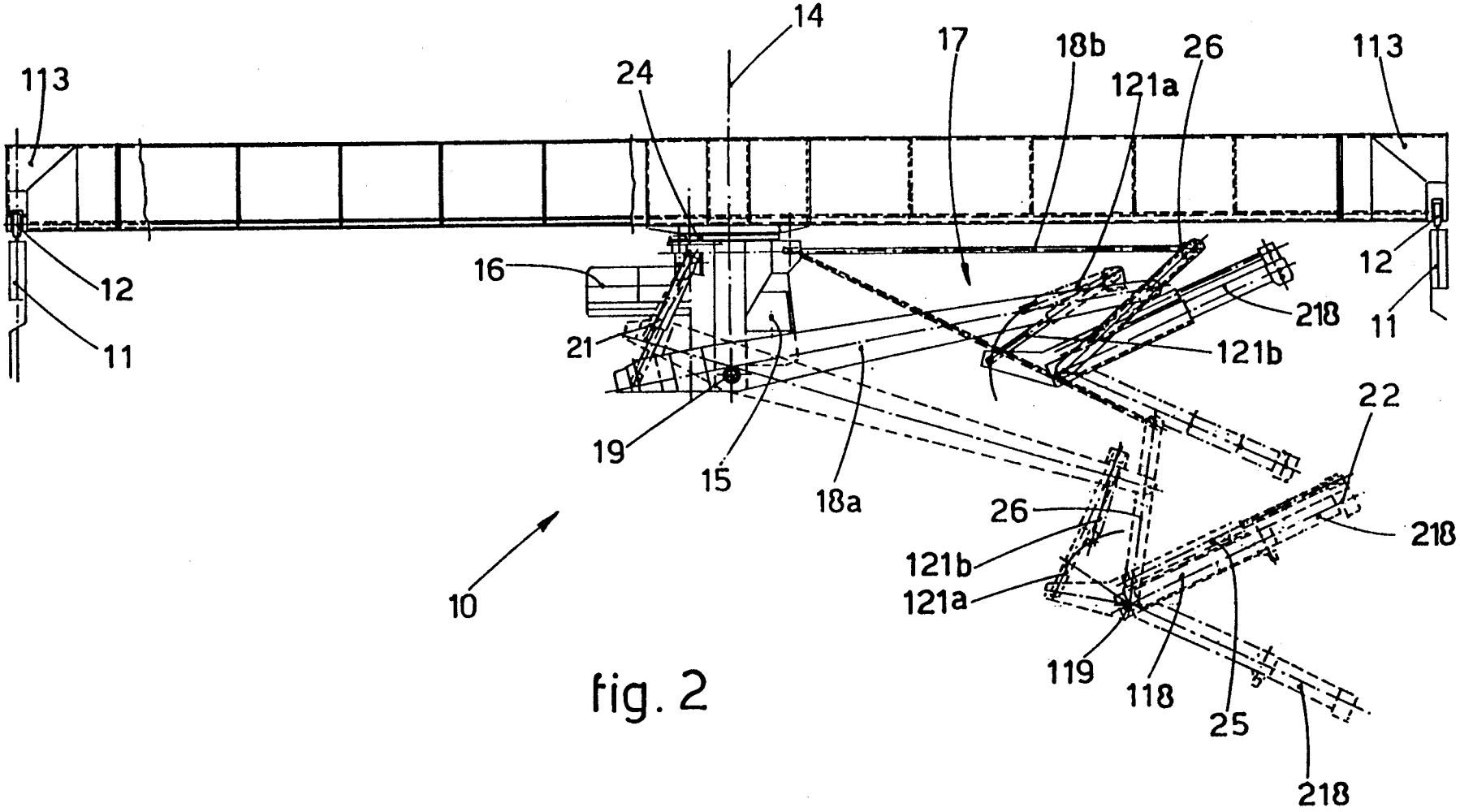
FIG. 2 is a side view of a variant of the invention.

In the cases of FIGS. 1 and 2 the beam 13 is a box-type beam and can be put under overpressure.

The height of the beam 13 may be such as to enable personnel to pass within it to reach the cage 15 or to carry out inspections or to accommodate the controls and services. In FIG. 2 the boom 17 comprises a first element conformed as an articulated quadrilateral with part-elements, namely a bearing arm 18*a*, and an arm 18*b* to maintain desired movements, the arm 18*b* being positioned higher and being shorter than the bearing arm 18*a*.

The two part-elements 18*a*–18*b* are anchored in such a manner that they can move relative to the central pivot 14 at one end and to a connecting bar 26 at their other end. The connecting bar 26 supports the second element 118 by means of a pivot 119.

Vertical movement of the first element 18*a*, 18*b* is obtained with the first cylinder/piston actuator 21, whereas the second cylinder/piston actuator 121*a*, 121*b* displaces the second element 118 vertically in relation to the first element 18*a*, 18*b*.

The second element 118, acting as a terminal boom, comprises a third element like telescopic body 218 which can be actuated by the cylinder/piston actuator 25.

I claim:

1. Bridge crane with articulated rotary boom, which includes a beam having a predetermined span that supports the boom, the boom being able to rotate in a substantially horizontal plane about a substantially vertical pivot, said substantially vertical pivot being located substantially at the centre of the span of the beam and being fixed below the beam, the boom consisting of at least two elements which can be positioned vertically in relation to each other, the boom being anchored by means of its first element to a rotary platform positioned below the beam, the bridge crane being characterized in that an operator's cage and a motor unit are provided on the rotary platform below the beam, the motor unit being offset laterally in contraposition to the boom as to act as a counterweight, the first element of the boom being able to move relative to said substantially horizontal plane and to be positioned vertically by means of a first cylinder/piston actuator, wherein the first element is conformed as an articulated quadrilateral and comprises a first bearing arm and a second arm supporting movement of said first arm, said second arm being shorter than said first arm, the first arm being anchored to said rotary platform at one end so as to be able to oscillate relative to the substantially horizontal plane and to a connecting bar at its other end, the connecting bar bearing a second element of said at least two elements of said boom on a pivot so that the second element can oscillate by means of a second cylinder/piston actuator.

2. Bridge crane as claimed in claim 1, in which the second of said at least two elements of said boom can be extended telescopically by means of a third cylinder/-piston actuator.

3. Bridge crane as claimed in claim 1 in which the beam is a box-type beam and provides an internal passage for access.

4. A bridge crane comprising:

a longitudinally extending horizontal beam able to move in a horizontal plane transversely to its longitudinal axis;

a rotary platform;

means for operably connecting said rotary platform to said beam at a position substantially at a center portion of the span of said beam;

a boom anchored to said rotary platform so as to be able to rotate about a substantially vertical pivot, said boom comprising a longitudinally extending bearing arm and a longitudinally extending support arm located above said bearing arm, each of said bearing arm and said support arm being hinged at a first end to said rotary platform so as to be able to move relative to said horizontal plane, said support arm being hinged to said rotary platform at a position above a position at which said bearing arm is hinged and said support arm being shorter than said bearing arm, and further comprising a connecting bar having first and second opposite ends, said first end of said connecting bar being pivotally connected to said support arm and said second end of said connecting bar being pivotally connected to a longitudinally extending second boom element, and wherein said a second end of said bearing arm is connected to said connecting bar at a position between said first and second ends of said connecting bar such that said second boom element can move relative to said horizontal plane; and means for moving and vertically positioning said bearing arm and second boom element.

5. A bridge crane according to claim 4, further comprising a third boom element and means for moving said third boom element telescopically in and out of said second boom element.

6. A bridge crane according to claim 4, further comprising an operator's cage fixed to said rotary platform.

7. A bridge crane according to claim 4, further comprising a motor unit fixed to said rotary platform an offset laterally in contraposition to the boom so as to act as a counterweight.

8. A bridge crane according to claim 4, wherein said second boom element is moved and positioned with respect to said connecting bar by a cylinder piston actuator.

* * * * *